US009829900B2

(12) United States Patent
Suzuki

(10) Patent No.: US 9,829,900 B2
(45) Date of Patent: Nov. 28, 2017

(54) VOLTAGE REGULATOR

(71) Applicant: SII Semiconductor Corporation, Chiba-shi, Chiba (JP)

(72) Inventor: Teruo Suzuki, Chiba (JP)

(73) Assignee: SII SEMICONDUCTOR CORPORATION, Chiba (JP)

( * ) Notice: Subject to any disclaimer, the term of this patent is extended or adjusted under 35 U.S.C. 154(b) by 0 days.

(21) Appl. No.: 15/367,802

(22) Filed: Dec. 2, 2016

(65) Prior Publication Data

US 2017/0160764 A1 Jun. 8, 2017

(30) Foreign Application Priority Data

Dec. 7, 2015 (JP) ..... 2015-238818

(51) Int. Cl.

| | |
|---|---|
| ***G05F 1/56*** | (2006.01) |
| ***G05F 1/569*** | (2006.01) |
| ***G05F 1/46*** | (2006.01) |
| *G05F 3/16* | (2006.01) |
| *G05F 1/567* | (2006.01) |
| *G05F 1/573* | (2006.01) |
| *G05F 1/565* | (2006.01) |

(52) U.S. Cl.

CPC ..... *G05F 1/569* (2013.01); *G05F 1/468* (2013.01); *G05F 1/562* (2013.01); *G05F 1/565* (2013.01); *G05F 1/567* (2013.01); *G05F 1/573* (2013.01); *G05F 3/16* (2013.01)

(58) Field of Classification Search

CPC . G05F 1/468; G05F 1/56; G05F 1/562; G05F 1/565; G05F 1/567; G05F 1/569; G05F 1/573; G05F 1/575

See application file for complete search history.

(56) References Cited

U.S. PATENT DOCUMENTS 5,757,172 A * 5/1998 Hunsdorf ..... G05F 1/567 323/277
2006/0238944 A1* 10/2006 Yamamoto ..... G05F 1/575 361/93.1
2008/0211313 A1* 9/2008 Nakamura ..... G05F 1/56 307/75

(Continued)

FOREIGN PATENT DOCUMENTS

JP 2005-100295 A 4/2005

*Primary Examiner* — Fred E Finch, III

(74) *Attorney, Agent, or Firm* — Brinks Gilson & Lione

(57) ABSTRACT

The voltage regulator includes an overheat protection circuit. The overheat protection circuit includes: a temperature sensing circuit; a voltage difference sensing circuit configured to output a current depending on a voltage difference between a power source voltage to be supplied to a power supply terminal and the output voltage; an output current monitoring circuit; a second reference voltage circuit configured to generate a second reference voltage; a comparator circuit configured to compare an output voltage of the temperature sensing circuit and the second reference voltage to each other; and an overheat protection transistor is configured to turn off the output transistor when the result of the comparison indicates an overheated state. The second reference voltage of the second reference voltage circuit is controlled based on an output current of the voltage difference sensing circuit and on an output current of the output current monitoring circuit.

6 Claims, 3 Drawing Sheets

(56) References Cited

U.S. PATENT DOCUMENTS

| | | | | |
|---|---|---|---|---|
| 2008/0272753 | A1* | 11/2008 | Kawashima | G05F 1/573 323/277 |
| 2009/0184748 | A1* | 7/2009 | Suzuki | G05F 1/569 327/513 |
| 2009/0206807 | A1* | 8/2009 | Imura | G05F 1/573 323/277 |
| 2015/0263507 | A1* | 9/2015 | Endo | G05F 1/567 361/18 |
| 2016/0111236 | A1* | 4/2016 | Jin | G05F 1/569 323/276 |
| 2016/0197554 | A1* | 7/2016 | Sakurai | G01R 19/00 323/271 |
| 2016/0211751 | A1* | 7/2016 | Kurozo | G05F 1/573 |

* cited by examiner

VOLTAGE REGULATOR

RELATED APPLICATIONS

This application claims priority under 35 U.S.C. §119 to Japanese Patent Application No. 2015-238818 filed on Dec. 7, 2015, the entire content of which is hereby incorporated by reference.

BACKGROUND OF THE INVENTION

1. Field of the Invention

The present invention relates to a voltage regulator including an overheat protection circuit.

2. Description of the Related Art

In general, a voltage regulator is configured to supply a current depending on a load of an electronic device connected to an output port, and energy consumption due to heat generation leads to electric power loss. Further, when a load current increases, a temperature of the voltage regulator rises excessively and the voltage regulator itself may be damaged. Accordingly, there is provided an overheat protection circuits configured to prevent the voltage regulator from reaching a predetermined temperature or higher.

Here, a related-art voltage regulator including an overheat protection circuit is described (e.g., see Japanese Patent Application Laid-open No. 2005-100295).

FIG. 3 is a circuit diagram of a related-art voltage regulator 200.

The voltage regulator 200 includes an overheat protection circuit 123 including a temperature sensing circuit 115, a reference voltage circuit 114, a comparator circuit 103, and transistors 104 and 110, and has the following configuration.

The temperature sensing circuit 115 is formed of a constant current circuit 101 and a diode 102, and is configured to output a voltage VF from a node between the constant current circuit 101 and the diode 102.

The reference voltage circuit 114 is formed of a reference voltage 106, a voltage follower circuit 105, and bleeder resistors 107, 108, and 109, and is configured to output a voltage VREF from a node between the resistors 107 and 108.

The comparator circuit 103 is configured to compare the voltage VF, which is output of the temperature sensing circuit 115, and the voltage VREF, which is output of the reference voltage circuit 114, to each other, and to output the result of the comparison. Output of the comparator circuit 103 is input to a gate of the transistor 104 and a gate of the transistor 110.

The transistor 104 has a source connected to a power supply terminal, and a drain connected to a gate of an output transistor (output driver) 111 of the voltage regulator 200. The transistor 110 has a source connected to a ground terminal, and a drain connected to a node between the resistors 108 and 109.

A voltage divider circuit formed of the resistors 112 and 113 is connected between a drain of the output transistor 111 and the ground terminal.

An error amplifier circuit 116 is configured to receive a divided voltage from the voltage divider circuit and a voltage of a reference voltage 117, and has an output terminal connected to the gate of the output transistor 111.

Temperature characteristics of the temperature sensing circuit 115 are based on temperature characteristics of a forward voltage of the diode 102, and the output voltage VF has a characteristic of being substantially −2 mV/° C. The output voltage VREF of the reference voltage circuit 114 may be set to any voltage value through adjustment of the bleeder resistors 107, 108, and 109 by trimming.

In a normal state in which an overheated state is not detected, VF>VREF holds. Thus, the output of the comparator circuit 103 becomes a HIGH state, and the transistor 104 is turned off. As a result, a gate voltage of the output transistor 111 reaches a voltage of the output terminal of the error amplifier circuit 116. Consequently, the output transistor is turned on, and an output voltage VOUT having a predetermined potential is output.

When the overheated state is detected, on the other hand, VREF>VF holds. Thus, the output of the comparator 103 becomes LOW, and the transistor 104 is turned on. As a result, the gate voltage of the output transistor 111 reaches a power source voltage, and the output transistor 111 is thus turned off Consequently, the output voltage VOUT has a ground potential.

As described above, when the overheat protection circuit 123 does not detect the overheated state, the related-art voltage regulator 200 normally operates and outputs, from the output transistor 111, the predetermined voltage VOUT having a power source potential or lower. When the overheat protection circuit 123 detects the overheated state, the related-art voltage regulator 200 turns off the output transistor 111 so that the output voltage VOUT has the ground potential. In this way, the voltage regulator itself may be protected from an excessive temperature rise thereof.

The transistor 110 is provided in order that the voltage regulator is changed from the overheated state to the normal state, and reversely from the normal state to the overheated state at different temperatures, that is, the voltage regulator has hysteresis.

In high-voltage and high-current voltage regulators, a large amount of electric power is lost due to a translational increase in load current under a high voltage state. The electric power is lost mainly due to energy consumption by an output driver generating heat. However, when the output driver and a diode of a temperature sensing circuit are arranged on a chip at positons away from each other, there is a temperature difference between a temperature near the center of the output driver at which heat is generated by the largest amount and a temperature at the diode of the temperature sensing circuit, due to thermal gradient.

In the related-art voltage regulator 200 of FIG. 3, there is a fear in that at a time when the overheat protection circuit 123 detects a predetermined overheated state, a temperature near the center of the output driver (output transistor 111) at which heat is generated by the largest amount may reach a temperature of the predetermined overheated state or higher, and exceed a heat resistant temperature of the output driver 111 to damage the output driver 111.

SUMMARY OF THE INVENTION

The present invention has been made in view of the above-mentioned problem, and provides a voltage regulator capable of preventing an output driver from being damaged due to heat.

According to one embodiment of the present invention, there is provided a voltage regulator, including: an output transistor configured to output an output voltage; a first reference voltage circuit configured to generate a first reference voltage; a voltage divider circuit configured to divide the output voltage to generate a divided voltage, and to output the divided voltage; an error amplifier circuit configured to receive the first reference voltage and the divided voltage, and to control the output transistor such that the output voltage is constant; and an overheat protection circuit configured to detect an overheated state, and to turn off the output transistor, the overheat protection circuit including: a temperature sensing circuit configured to output a voltage depending on temperature; a voltage difference sensing circuit configured to output a current depending on a voltage difference between a power source voltage to be supplied to a power supply terminal and the output voltage; an output current monitoring circuit configured to output a current depending on a current flowing through the output transistor; a second reference voltage circuit configured to generate a second reference voltage; a comparator circuit configured to compare an output voltage of the temperature sensing circuit and the second reference voltage to each other; and an overheat protection transistor that includes a gate for receiving a result of the comparison by the comparator circuit, and is configured to turn off the output transistor when the result of the comparison indicates the overheated state, the second reference voltage of the second reference voltage circuit being controlled based on an output current of the voltage difference sensing circuit and on an output current of the output current monitoring circuit.

According to the present invention, the second reference voltage is controlled based on an output current of the voltage difference sensing circuit, which is configured to output a current depending on a voltage difference between the power source voltage to be supplied to the power supply terminal and the output voltage, and on an output current of the output current monitoring circuit, which is configured to output a current depending on a current flowing through the output transistor. With such a configuration, the output transistor can be turned off based on an increase in electric power consumption by the output transistor. It is therefore possible to prevent the output transistor from being damaged due to heat.

DETAILED DESCRIPTION OF THE PREFERRED EMBODIMENTS

Now, an embodiment of the present invention is described with reference to the drawings.

Figure 1:
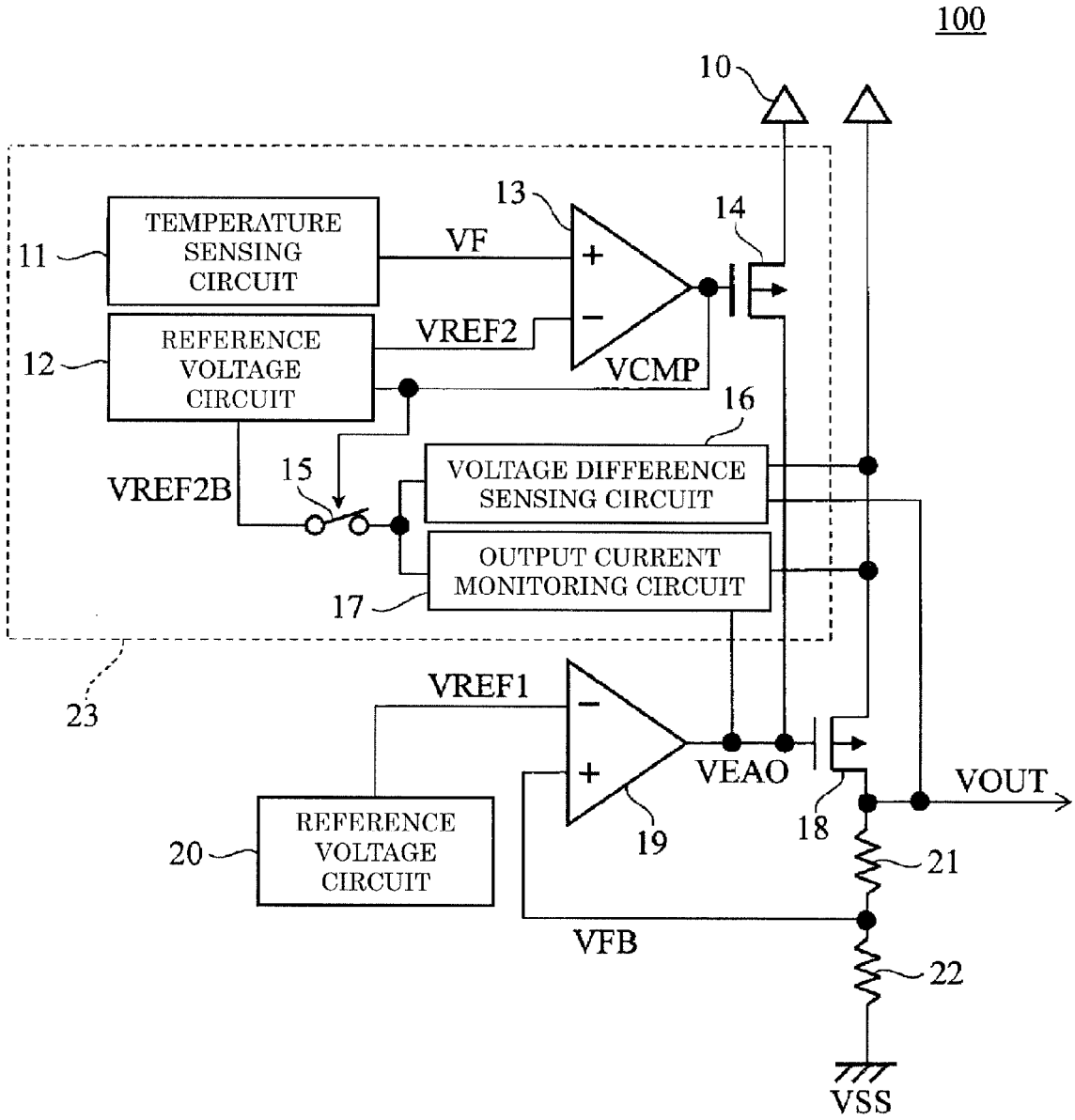
FIG. 1 is a circuit diagram of a voltage regulator having a built-in overheat protection circuit according to one embodiment of the present invention.

FIG. 1 is a circuit diagram of a voltage regulator 100 of the present invention.

The voltage regulator 100 includes an output transistor (output driver) 18, an error amplifier circuit 19, a reference voltage circuit 20, a voltage divider circuit formed of resistors 21 and 22, and an overheat protection circuit 23, and has the following configuration.

The error amplifier circuit 19 is configured to compare a divided voltage VFB generated by dividing an output voltage VOUT by the voltage divider circuit, and a reference voltage VREF1 generated by the reference voltage circuit 20 to each other. The error amplifier circuit 19 is configured to output a voltage VEAO as the result of the comparison to supply a gate of the output transistor 18 with the voltage VEAO.

With such a configuration, the voltage regulator 100 outputs a constant output voltage VOUT from an output terminal thereof in a normal state.

The overheat protection circuit 23 is formed of a temperature sensing circuit 11, a reference voltage circuit 12, a comparator circuit 13, a PMOS transistor (overheat protection transistor) 14, a switch 15, a voltage difference sensing circuit 16, and an output current monitoring circuit 17.

Figure 3:
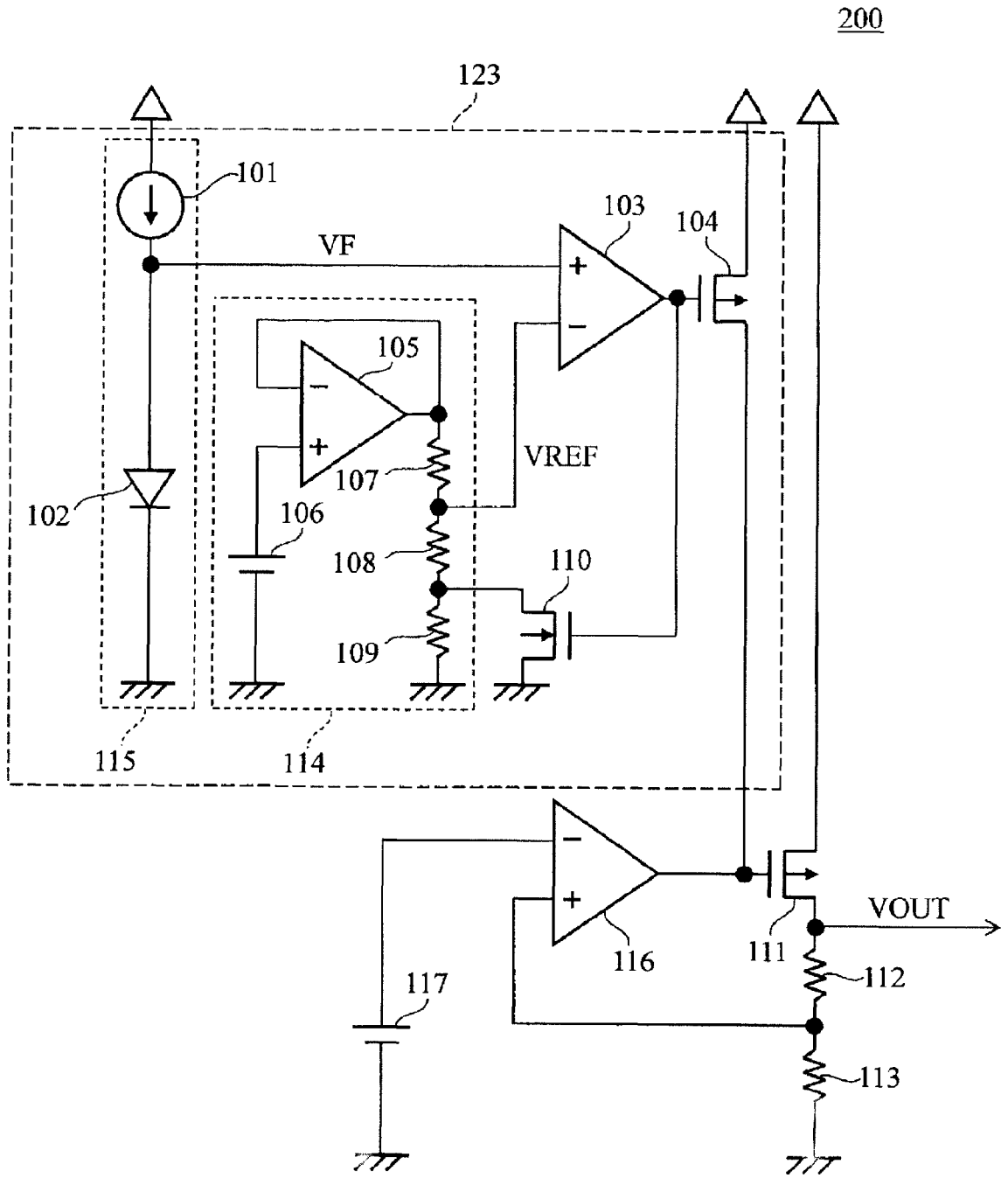
FIG. 3 PRIOR ART
FIG. 3 is a circuit diagram of a related-art voltage regulator having a built-in overheat protection circuit.

The temperature sensing circuit 11 has a configuration similar to that of the temperature sensing circuit 115 illustrated in FIG. 3. Temperature characteristics of the temperature sensing circuit 11 are based on temperature characteristics of a forward voltage of a diode, and an output voltage VF has a characteristic of being substantially −2 mV/° C.

The comparator circuit 13 is configured to compare the output voltage VF of the temperature sensing circuit 11 and an output voltage VREF2 of the reference voltage circuit 12 to each other, and to output a voltage VCMP as the result of the comparison. The output voltage VCMP of the comparator circuit 13 is supplied to a gate of the PMOS transistor 14 having a source connected to the power supply terminal 10 and a drain connected to a gate of the output transistor 18.

The voltage difference sensing circuit 16 is connected to the power supply terminal 10, the output terminal of the voltage regulator 100, and one end of the switch 15.

The output current monitoring circuit 17 is connected to the power supply terminal 10, an output terminal of the error amplifier circuit 19, and the one end of the switch 15.

The other end of the switch 15 is connected to the reference voltage circuit 12, and the switch 15 is controlled to be turned on and off with the output voltage VCMP of the comparator circuit 13. The switch 15 is turned on when the voltage VCMP is HIGH, and is turned off when the voltage VCMP is LOW.

Figure 2:
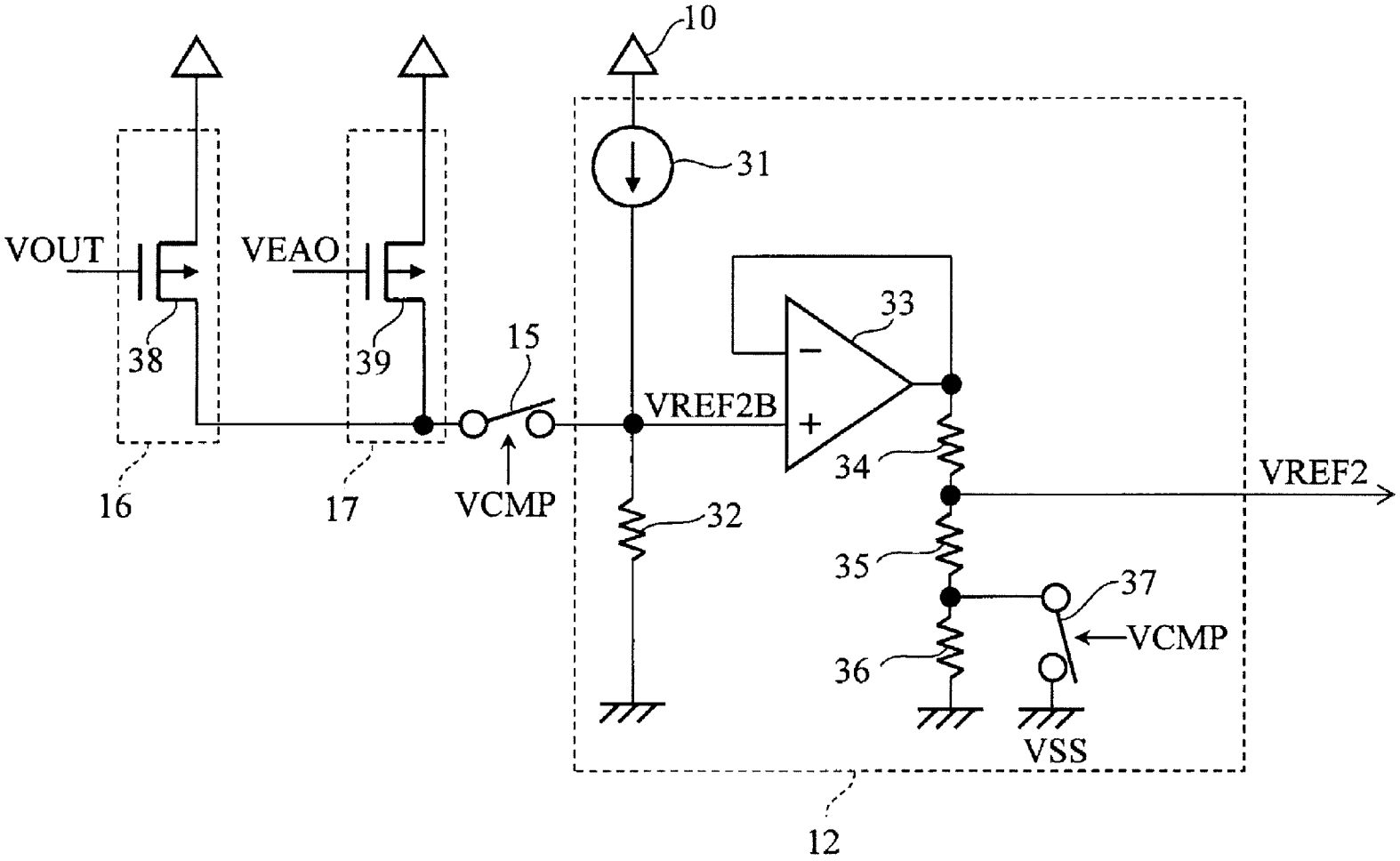
FIG. 2 is a circuit diagram of a reference voltage circuit, an electric power detecting circuit, a voltage difference sensing circuit, and an output current monitoring circuit in the overheat protection circuit illustrated in FIG. 1.

Next, the details of the reference voltage circuit 12, the switch 15, the voltage difference sensing circuit 16, and the output current monitoring circuit 17 that are illustrated in FIG. 1 are described with reference to FIG. 2.

The reference voltage circuit 12 is formed of a constant current circuit 31, a resistor 32, a voltage follower circuit 33, bleeder resistors 34, 35, and 36, and a switch 37.

The bleeder resistors 34, 35, and 36 are connected between an output of the voltage follower circuit 33 and a ground terminal VSS.

The switch 37 has one end connected to a node between the resistors 35 and 36, and the other end connected to the ground terminal VSS, and is controlled to be turned on and off with the output voltage VCMP of the comparator circuit 13. The switch 37 is turned on when the voltage VCMP is HIGH, and is turned off when the voltage VCMP is LOW.

A node between the constant current circuit 31 and the resistor 32 is connected to one input terminal of the voltage follower circuit 33.

The voltage difference sensing circuit 16 is formed of a transistor 38 having a source connected to the power supply terminal 10, a gate connected to VOUT, and a drain connected to the one end of the switch 15. Further, the output current monitoring circuit 17 is formed of a transistor 39 having a source connected to the power supply terminal 10, a gate connected to the gate of the output transistor 18 illustrated in FIG. 1, and a drain connected to the one end of the switch 15.

Next, the operation of the overheat protection circuit 23 is described with reference to FIG. 1 and FIG. 2.

In the normal state, the reference voltage circuit 12 outputs the voltage VREF2 having a predetermined voltage value corresponding to a predetermined temperature for detecting an overheated state.

When a temperature of the voltage regulator 100 increases due to self-heating or increasing peripheral temperature, the output voltage VF of the temperature sensing circuit 11 decreases with the characteristic of being about −2 mV/° C. Then, the comparator circuit 13 outputs LOW when the output voltage VF of the temperature sensing circuit 11 falls below the output voltage VREF2 of the reference voltage circuit 12.

As a result, the PMOS transistor 14 is turned on and a gate voltage of the output transistor 18 thus increases. Hence, the output transistor 18 is turned off, and the output voltage VOUT of the voltage regulator becomes LOW.

Next, as a main feature of the present invention, the operation of the overheat protection circuit 23 for preventing the output driver from being damaged due to heat is described.

Under the above-mentioned normal state, when a voltage difference between a power source voltage of the power supply terminal 10 and the output voltage VOUT increases, current flows from the power supply terminal 10 to the ground terminal VSS via the transistor 38 of the voltage difference sensing circuit 16, the switch 15, and the resistor 32. Further, when an output current flowing through the output transistor 18 increases, current flows from the power supply terminal 10 to the ground terminal VSS via the transistor 39 of the output current monitoring circuit 17, the switch 15, and the resistor 32.

As a result, a current flowing through the resistor 32 increases, and the voltage VREF2B at the node between the constant current circuit 31 and the resistor 32 increases. Consequently, the output voltage VREF2 of the reference voltage circuit 12 exceeds the above-mentioned predetermined voltage value. That is, the second reference voltage VRERF2 is controlled based on an output current of the voltage difference sensing circuit 16 and on an output current of the output current monitoring circuit 17.

The output voltage of the temperature sensing circuit 11 has the constant characteristic of being about −2 mV/° C. Thus, the temperature for detecting the overheated state is set to a low value when the output voltage VREF2 of the reference voltage circuit 12 increases.

Hence, when the reference voltage VREF2 that has been increased by the voltage difference sensing circuit 16, the output current monitoring circuit 17, the switch 15, and the reference voltage circuit 12 exceeds the output voltage VF of the temperature sensing circuit 11, the output voltage VCMP of the comparator circuit 13 becomes LOW, and the PMOS transistor 14 is thus turned on.

As a result, the voltage VEAO to be supplied to the gate of the output transistor 18 reaches the power source voltage of the power supply terminal 10. Then, the output transistor 18 is turned off, and the output voltage VOUT of the voltage regulator becomes LOW. In short, output of the voltage regulator is stopped.

At this time, the switches 15 and 37 are turned off based on the output voltage VCMP of the comparator circuit 13 being LOW.

Here, the switch 15 is turned off because of the following reason. Specifically, if the switch 15 is still on after the overheated state is detected and the output is stopped, there is a fear in that a current of the output current monitoring circuit may all flow out because the output is stopped, with the result that the voltage regulator may return to the normal state soon.

Further, the switch 37 is turned off in order to decrease a temperature for canceling the overheated state. Specifically, the reference voltage VREF2 that has increased as described above is set to a voltage that is higher than the predetermined voltage value by a resistance value of the resistor 36, by turning off the switch 37. When the output voltage VREF2 of the reference voltage circuit 12 is set to a high value, the reference temperature for canceling the overheated state after the overheated state is detected once may be set to a low value.

The output voltage of the temperature sensing circuit 11 increases when the output of the voltage regulator is stopped due to detection of the overheated state, and a temperature of the voltage regulator decreases. When the temperature falls below the predetermined temperature for canceling the overheated state, the output voltage of the temperature sensing circuit 11 exceeds the output voltage VREF2 of the reference voltage circuit 12, and the comparator circuit 13 outputs HIGH. Then, the PMOS transistor 14 is turned off, and the gate voltage of the output transistor 18 thus decreases. Consequently, the output transistor 18 is turned on, and the output voltage VOUT of the voltage regulator reaches the predetermined voltage again.

As described above, according to this embodiment, even when a temperature being sensed by the temperature sensing circuit 11 is lower than the predetermined temperature, the output voltage VREF2 of the reference voltage circuit 12 is controlled based on a current that is output by the voltage difference sensing circuit 16 and depends on a voltage difference between the power source voltage and the output voltage VOUT, and on a current that is output by the output current monitoring circuit 17 and depends on a current flowing through the output transistor. In short, the output voltage VREF2 is controlled based on electric power consumption by the output transistor 18. In this way, the reference temperature for detecting the overheated state may be set to a low value. It is therefore possible to prevent the output transistor from being damaged due to heat.

As described above, according to the present invention, a detection temperature may be set to a low value when electric power loss is large. Further, a functional test of overheat protection circuits in mass production may be performed under low temperature by setting electric power loss to a large value such that a detection temperature decreases. When the test may be performed under low temperature, there are provided effects that waiting time for reaching a set temperature is reduced, and necessity of high-temperature members is eliminated to reduce costs.

What is claimed is:

1. A voltage regulator, comprising:

an output transistor configured to output an output voltage;

a first reference voltage circuit configured to generate a first reference voltage;

a voltage divider circuit configured to divide the output voltage to generate a divided voltage, and to output the divided voltage;

an error amplifier circuit configured to receive the first reference voltage and the divided voltage, and to control the output transistor such that the output voltage is constant; and an overheat protection circuit configured to detect an overheated state, and to turn off the output transistor, the overheat protection circuit comprising:

a temperature sensing circuit configured to output a voltage depending on temperature;

a voltage difference sensing circuit configured to output a current depending on a voltage difference between a power source voltage to be supplied to a power supply terminal and the output voltage;

an output current monitoring circuit configured to output a current depending on a current flowing through the output transistor;

a second reference voltage circuit configured to generate a second reference voltage;

a comparator circuit configured to compare an output voltage of the temperature sensing circuit and the second reference voltage to each other; and an overheat protection transistor that includes a gate for receiving a result of the comparison by the comparator circuit, and is configured to turn off the output transistor when the result of the comparison indicates the overheated state, the second reference voltage of the second reference voltage circuit being controlled based on an output current of the voltage difference sensing circuit and on an output current of the output current monitoring circuit.

2. A voltage regulator according to claim 1, further comprising a first switch that is provided between an output of the voltage difference sensing circuit and an output of the output current monitoring circuit, and the second reference voltage circuit, the first switch being turned on when the output transistor is turned on and being turned off when the output transistor is turned off, wherein the second reference voltage circuit comprises:

a constant current circuit connected between the power supply terminal and one end of the first switch;

a resistor element connected between the one end of the first switch and a ground terminal;

a voltage follower circuit configured to receive, as input, a voltage of the one end of the first switch;

a bleeder resistor comprising a first resistor, a second resistor, and a third resistor connected between an output of the voltage follower circuit and the ground terminal in the stated order; and a second switch that includes one end connected to a node between the second resistor and the third resistor and another end connected to the ground terminal, the second switch being turned on when the output transistor is turned on and being turned off when the output transistor is turned off, and wherein a voltage of a node between the first resistor and the second resistor reaches the second reference voltage.

3. A voltage regulator according to claim 2, wherein the voltage difference sensing circuit comprises a transistor including a source connected to the power supply terminal, a gate connected to the output voltage, and a drain connected to the one end of the first switch.

4. A voltage regulator according to claim 3, wherein the output current monitoring circuit comprises a transistor including a source connected to the power supply terminal, a gate connected to a gate of the output transistor, and a drain connected to the one end of the first switch.

5. A voltage regulator according to claim 2, wherein the output current monitoring circuit comprises a transistor including a source connected to the power supply terminal, a gate connected to a gate of the output transistor, and a drain connected to the one end of the first switch.

6. A voltage regulator according to claim 2, wherein the first switch and the second switch are controlled based on output of the comparator circuit.

* * * * *